US005097241A

United States Patent [19]

Smith et al.

[11] Patent Number: 5,097,241

[45] Date of Patent: Mar. 17, 1992

[54] COOLING APPARATUS FOR WINDINGS

[75] Inventors: Edward Smith, Pecatonica; P. John Dhyanchand, Rockford, both of Ill.

[73] Assignee: Sundstrand Corporation, Rockford, Ill.

[21] Appl. No.: 459,000

[22] Filed: Dec. 29, 1989

[51] Int. Cl.[5] ..... H01F 27/10

[52] U.S. Cl. ..... 336/60; 165/168; 336/61

[58] Field of Search ..... 336/55, 60, 61, 62; 165/168; 310/64, 65

[56] References Cited

U.S. PATENT DOCUMENTS

| | | | |
|---|---|---|---|
| 853,843 | 5/1907 | Troy | 336/60 |
| 1,394,044 | 10/1921 | Stephans | 336/61 |
| 1,912,903 | 6/1933 | Long | 336/60 |
| 2,547,045 | 4/1951 | Sabol . | |
| 2,547,065 | 4/1951 | Wadhams . | |
| 2,577,825 | 12/1951 | Strickland . | |
| 3,144,627 | 8/1964 | Dunnabeck et al. | 336/55 |
| 3,428,928 | 2/1969 | Maines | 336/61 |
| 3,437,965 | 4/1969 | Ragsdale | 336/61 |
| 3,564,470 | 2/1971 | Van Nice | 336/60 |
| 3,810,303 | 5/1974 | Hoell | 336/61 X |
| 4,039,990 | 8/1977 | Philip | 336/60 |
| 4,543,552 | 9/1985 | Fantou | 336/60 |
| 4,577,175 | 3/1986 | Burgher et al. | 336/61 |

FOREIGN PATENT DOCUMENTS

| | | | |
|---|---|---|---|
| 111162 | 6/1928 | Austria | 336/60 |
| 2218659 | 10/1973 | Fed. Rep. of Germany . | |
| 249488 | 4/1948 | Switzerland . | |

*Primary Examiner*—Thomas J. Kozma

*Attorney, Agent, or Firm*—Marshall, O'Toole, Gerstein, Muray & Bicknell

[57] ABSTRACT

A cooling apparatus for windings provides the ability to cool transformer windings having many turns during high frequency use with most any coolant. The cooling apparatus comprises a thermally conductive, coolant-isolating conduit having a channel therethrough for the passage of coolant disposed between the turns of the winding in heat transfer relationship therewith.

8 Claims, 3 Drawing Sheets

Fig. 1
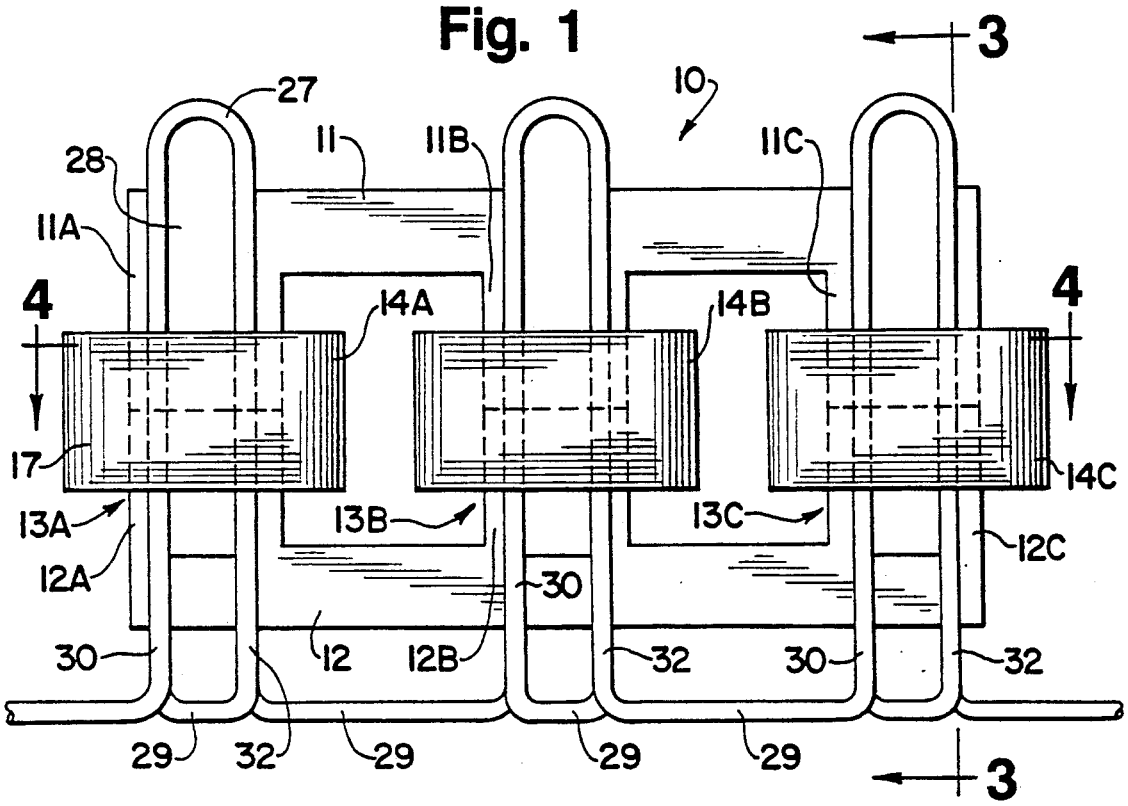
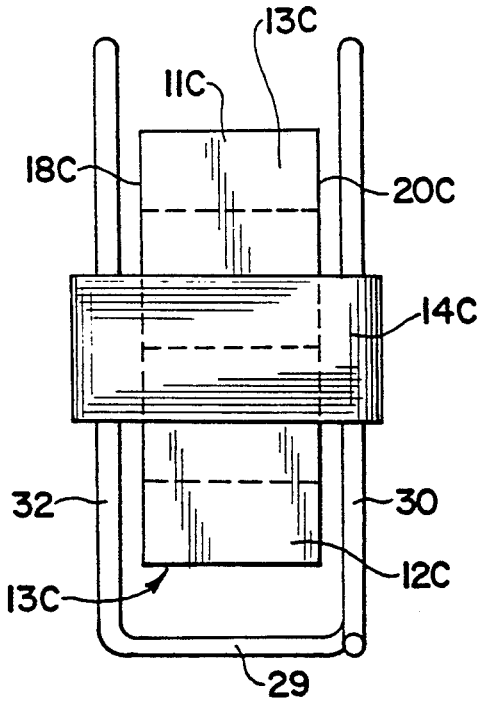
Fig. 2
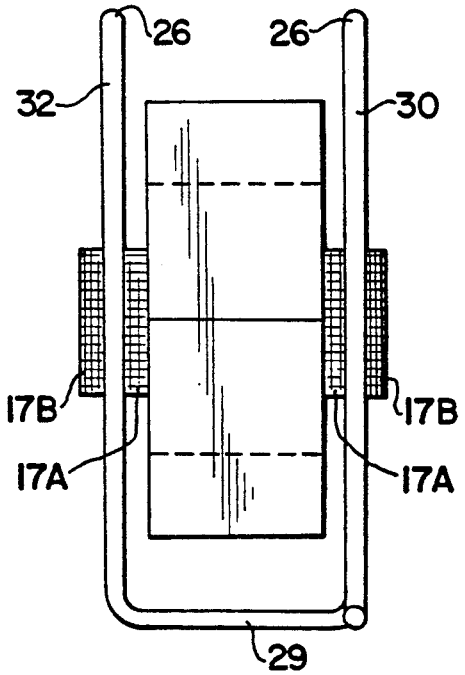
Fig. 3

Fig. 4
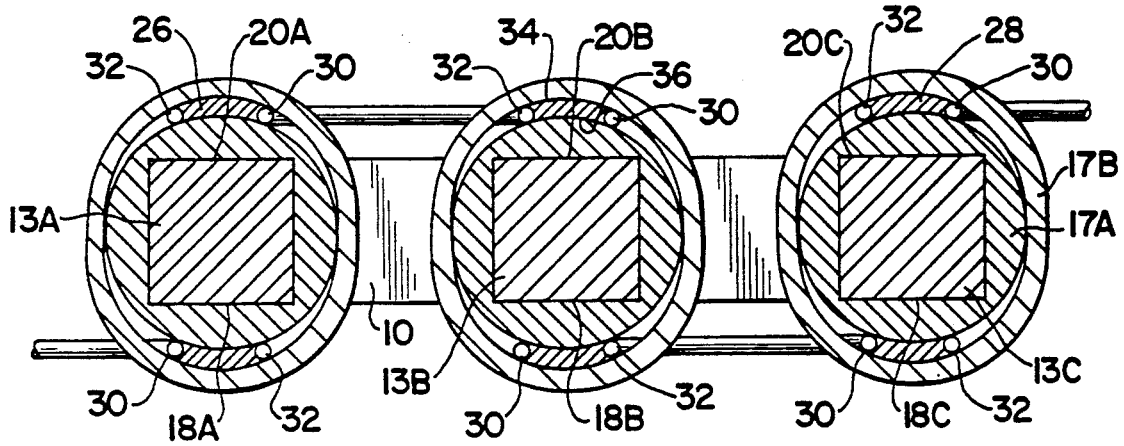
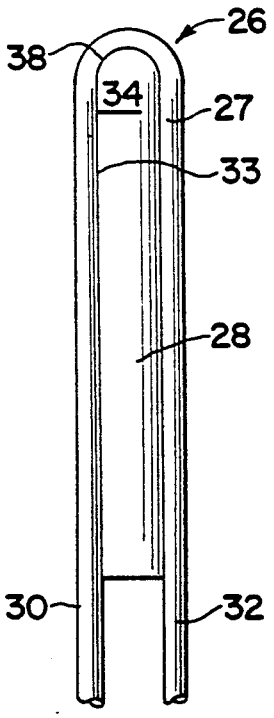
Fig. 5
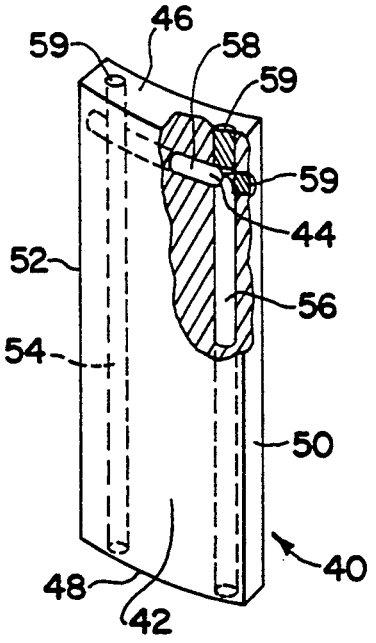
Fig. 6

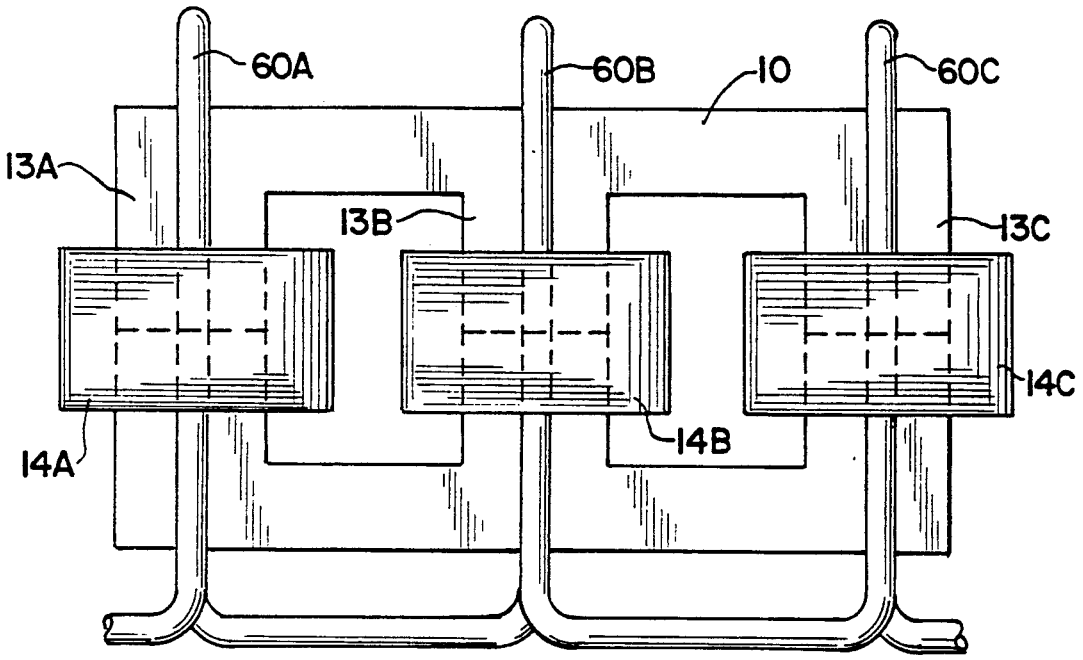
Fig. 7
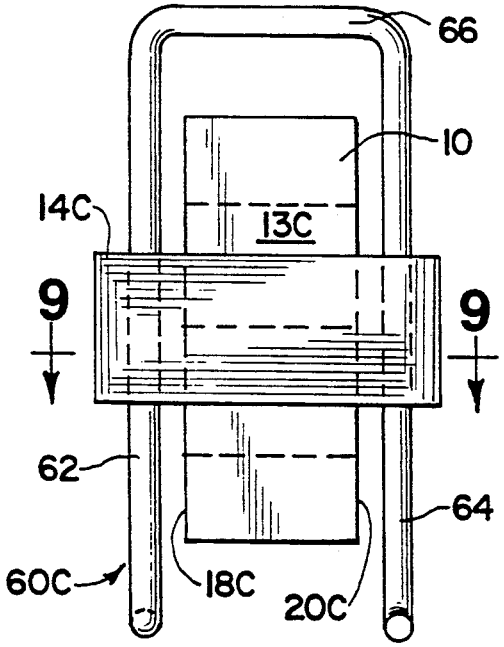
Fig. 8
Fig. 9
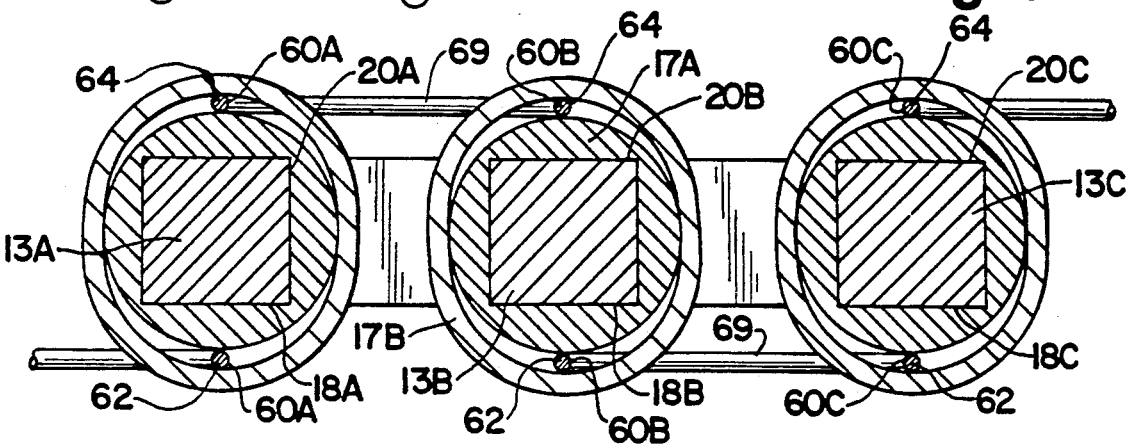

COOLING APPARATUS FOR WINDINGS

TECHNICAL FIELD

The present invention relates generally to the cooling of windings, and more particularly to an apparatus for cooling the windings of a transformer.

BACKGROUND ART

A transformer is often used to step up or step down voltage and usually consists of one or more windings wound on a magnetic core. During operation, electrical energy is transformed into heat energy due in large part to eddy currents and hysteresis losses. Excessive heating of a transformer can cause adverse results, such as reduced efficiency and damage to the transformer. During low frequency use under 400 Hz., most of the heat is produced in the core of the transformer. However, at higher frequencies above 400 Hz., losses in the core decrease due to the smaller magnitudes of eddy currents. At the same time, however, heat is produced in the windings due to $I^2R$ losses and skin effect. The heat produced in the windings increases with frequency and may cause fatigue and destruction of the windings or may adversely affect other components in the proximity of the transformer. Also the windings must have a large diameter and must be overrated to withstand the heat produced.

The prior art has disclosed attempts to cool transformers or parts thereof. However, the prior art devices are not entirely satisfactory for cooling transformer windings during high frequency use.

German Patent No. 2,218,659 discloses a cooling system which includes multiple axial cooling channels disposed concentrically around a transformer core. These channels run parallel to one another and are disposed between groups of concentric windings. The parallel channels are formed by wrapping the windings on coaxial formers of increasing diameter that are placed around the core and supported radially by spacers. The windings are disposed within the cooling channels themselves. Fans blow cooling air through these parallel channels to cool the windings. Because the windings are within the cooling channels, only coolants which do not react with the insulation of the windings can be employed. This system also increases the size of the transformer as there must be space between each concentric group of windings for the passage of air. In addition, since the coaxial formers completely encircle the core, they may undesirably form secondary windings.

Swiss Patent No. 249,488 also appears to disclose several non-enclosed axial cooling channels disposed concentrically around a transformer core which is disposed in an oil bath. These channels run parallel to one another and are formed between groups of high voltage windings. These non-enclosed channels expose the high voltage windings to the coolant and thus limit the type of coolant to ones which do not react with the winding insulation. These channels also are only able to cool the high voltage windings surrounding the channels and not low voltage windings wrapped about the high voltage windings.

Wadhams, U.S. Pat. No. 2,547,065, discloses a transformer cooling system consisting of hollow cooling plates through which coolant passes. These plates are located between the laminations of a transformer core. This system, however, would be inefficient when used to cool sets of transformer windings having a great number of turns since only the innermost windings closest to the cooling plates could be cooled.

Sabol, U.S. Pat. No. 2,547,045, also discloses a first cooling system consisting of cooling plates between core laminations of a transformer. The edges of these plates contain tubing for the passage of coolant. A second cooling system disclosed by Sabol includes tubing attached externally to legs of the core. Both these systems, like that disclosed in Wadhams, would be inefficient when used to cool the windings of a transformer having a great many turns.

Burgher et al., U.S. Pat. No. 4,577,175, Dunnabeck et al., U.S. Pat. No. 3,144,627 and Strickland, U.S. Pat. No. 2,577,825, all disclose cooling systems where at least a portion of a winding is formed from a tubular member through which a fluid coolant passes. These cooling systems are not practical, however, for a transformer that requires windings having many turns since the tubular member would occupy a large volume, causing the resulting transformer to be unduly large.

SUMMARY OF THE INVENTION

In accordance with the present invention, a cooling apparatus simply and efficiently cools windings, such as those wrapped around a transformer core.

In general, a cooling apparatus for windings having two turns disposed about a coil form includes a thermally conductive, coolant-isolating conduit having a channel therethrough for coolant passage, the conduit being disposed between the turns of the winding in heat transfer relation therewith.

More specifically, the preferred embodiment comprises a cooling apparatus for the windings of a transformer having a core with a plurality of legs, each leg having first and second opposed sides and a set of windings including a number of turns disposed about each leg. A first heat exchanger is disposed between the turns of the windings facing the first side of the core leg and a second heat exchanger is disposed between the turns of the winding facing the second side of the core leg. Each heat exchanger preferably comprises a U-shaped, coolant-isolating conduit having two legs and a channel therethrough for the passage of coolant and a closed U-shaped thermally conductive plate in heat transfer contact with the U-shaped conduit.

A second embodiment of the invention for use with a transformer of the above-described type comprises a plurality of U-shaped, coolant-isolating conduits having a pair of legs and a channel therethrough for passage of coolant wherein a first conduit leg is disposed between the turns of one set of windings facing the first side of the core leg and a second conduit leg is disposed between the turns of the same set of windings facing the second side of the core leg.

The present invention allows the windings of a transformer having a large number of turns to be efficiently cooled during high frequency use employing almost any coolant.

BRIEF DESCRIPTION OF THE DRAWING

FIG. 1 is a front elevational view of a preferred embodiment of the cooling apparatus of the present invention;

FIG. 2 is a side elevational view of the embodiment of FIG. 1;

FIG. 3 is a cross-sectional view taken generally along the lines 3—3 of FIG. 1;

FIG. 4 is a cross-sectional view taken generally along the lines 4—4 of FIG. 1;

FIG. 5 is a front elevational view of the heat exchanger of the present invention;

FIG. 6 is a perspective view, partly in section, of an alternative heat exchanger embodiment;

FIG. 7 is a front elevational view of a further embodiment of a cooling system according to the present invention;

FIG. 8 is a side elevational view of the embodiment of FIG. 7; and

FIG. 9 is a cross-sectional view taken generally along the lines 9—9 of FIG. 8.

DETAILED DESCRIPTION OF THE INVENTION

Referring to the drawings, FIGS. 1-5 show the preferred embodiment of the present invention. A three-phase transformer core 10 is formed from two identical, E-shaped laminated core sections 11 and 12, each section having three legs 11A-11C and 12A-12C, respectively. The three legs 11A-11C of section 11 are butted and held in place by suitable means (not shown) against the three legs 12A-12C of section 12. The legs of both sections 11 and 12 form three core legs 13A-13C. Wrapped around each core leg 13A-13C is a set of windings 14A-14C, respectively. Each set of windings 14A-14C has at least two turns 17. These turns are lacquered or otherwise insulated to prevent shorting. As best seen in FIG. 4, each core leg 13A-13C has a first side 18A-18C and a second opposite side 20A-20C, respectively. To cool the windings, heat exchangers 26 of the present invention are located between the turns 17 of the sets of windings 14A-14C. Preferably, but not necessarily, each core leg has one heat exchanger facing the first side 18 and one heat exchanger facing the second side 20, it being understood that the number and location of the heat exchangers 26 may vary, if necessary or desirable.

As seen in FIGS. 4 and 5, each heat exchanger 26 comprises a thermally conductive, coolant-isolating, U-shaped conduit 27 and preferably, although not necessarily, a closed U-shaped thermally conductive plate 28. The conduit 27 has a channel therethrough for the passage of coolant. The conduit 27 is typically fabricated of non-magnetic round or square metal tubing, such as copper tubing. The conduit 27 may alternatively be magnetically permeable. Each conduit 27 has a first leg 30 and a second leg 32 and an interior U-shaped edge 33. The conduit 27 isolates the coolant from the windings 14 and therefore allows most liquid or gaseous coolants to be employed.

The thermally conductive plate 28 may be constructed of a thermally conductive material, preferably, but not limited to non-magnetic metals such as copper, aluminum, titanium, stainless steel or alloys thereof. Ceramic or fibrous materials, though not preferred, may also be used. Aluminum is preferred as it is light in weight. The thermally conductive plate 28 has a first side 34, a second opposed side 36, and a U-shaped side edge 38. Both the first 34 and second 36 sides of the plate 28 may be flat or curved. If curved, the first side 34 may be convex and the second side 36 concave. This curving of the first and second sides of the plate 28 allows the plate to better conform to the curved shape of the winding turns. This improves the heat transfer contact of the plate with the windings. In addition, the U-shaped side edge 38 of the plate may also be shaped for better heat transfer with the conduit 27 through which coolant passes. To ensure cooling of all the turns of the windings, the plate 28 should preferably, although not necessarily, have a height at least as great as the axial extent of the windings. In the preferred embodiment, the conduit is fabricated of round tubing and the U-shaped edge 38 in contact with the conduit is concave to allow greater contact, and hence better heat transfer, between the plate 28 and conduit 27. Also, the U-shaped side edge 38 of the plate 28 is preferably bonded to the interior U-shaped edge 33 of the conduit by a thermally conductive bonding agent, such as epoxy, or is casted or clamped thereto.

In the preferred embodiment, as best seen in FIGS. 3 and 4, two heat exchangers 26 are placed between the turns 17 of the windings about each core leg 13A-13C. This is most easily accomplished by wrapping several turns 17A of the windings on a bobbin, or other turn former, placing the two heat exchangers 26 on opposite outer sides of the turns 17A so that the second sides 36 of the thermally conductive plates 28 contact the turns 17A and then wrapping remaining turns 17B around the bobbin and over the first sides 34 of the thermally conductive plates of the two heat exchangers 26. The bobbin is then removed and the legs 11A-11C and 12A-12C of the E-shaped core sections 11 and 12 are placed within the windings and butted against one another to form the core legs 13A-13C. After this placement, opposed sides 18A-18C and 20A-20C of each core leg 13A-13C face the second side 36 of the thermally conductive plate 28 of one of the heat exchangers 26.

As seen in FIGS. 3 and 4, the heat exchangers 26 are thus held in place between the turns 17A and the turns 17B. This placement of the heat exchangers 26 within the turns of the windings allows excellent heat transfer between the windings and the heat exchanger to efficiently cool the windings. This heat transfer is enhanced by the shaping of the thermally conductive plate 28 which conforms both to the shape of the windings 17 and the shape of the conduit 27.

The conduits 27 of the heat exchangers 26 can be connected in any manner to pass coolant therethrough. Preferably, all the conduits 27 are connected in series by connective tubing 29 fabricated of material identical to or similar to that of the U-shaped conduit 27. In this manner, coolant enters the first leg 30 of the heat exchanger conduit 27 facing the first side 18A of core leg 13A and exits the second leg 32 of this conduit. Coolant then passes through connective tubing 29 into the second leg 32 of the heat exchanger conduit 27 facing the second side 20A of core leg 13A and exits the first conduit leg 30. Coolant next passes through connective tubing 29 and enters the second leg 32 of the heat exchanger conduit 27 facing the second side 20B of the core leg 13B and exits the first leg 30 thereof. Thereafter coolant flows in a similar fashion through the heat exchangers 26 facing the sides 18B, 18C and 20C of the legs 13B and 13C and the connective tubing 29 connected therebetween. Since not all the heat exchangers are connected in a closed loop, the metallic tubing of the U-shaped heat exchanger conduits 27 and the connective tubing 29 between the heat exchangers do not form a shorted turn.

If desired, each heat exchanger may instead be of one-piece construction. As seen in FIG. 6, a heat exchanger 40 includes a thermally conductive plate 42 through which channels are drilled or otherwised formed to construct a U-shaped conduit 44. The plate 42 has a first edge 46, a second edge 48 opposed thereto, a third edge 50 and a fourth edge 52 opposed to the third edge. The U-shaped conduit is most easily formed by drilling three channels. Two channels are drilled between the first edge 46 and second edge 48 to form a first conduit leg 54 and a second conduit leg 56, respectively. A third channel 58 is drilled between the third edge 50 and the fourth edge 52. This third channel 58 connects the first leg 54 to the second leg 56. The channel openings on the first, third and fourth edges 46, 50, 52 of the plate 42 caused by this drilling are closed by plugs 59 which are preferably constructed of material similar to that of plate 42. The plugs 59 are secured in the opening in any conventional manner. The plate 42 may be curved like the plate 28 to improve the heat transfer contact with the windings. The plate 42 may also be constructed of the same materials as the plate 28. The heat exchangers 40 may be placed between turns of the windings and be connected by connective tubing in any manner, such as that described previously in connection with the preferred embodiment.

Another embodiment of the present invention is shown in FIGS. 7, 8 and 9 wherein like reference numbers identify the same elements as shown in FIGS. 1-5. A three-phase transformer core 10 has sets of windings 14A-14C wrapped around core legs 13A-13C, respectively. Each set of windings 14A-14C has at least two turns 17. Each core leg 13A-13C has a first side 18A-18C and an opposed second side 20A-20C, respectively. U-shaped thermally conductive, coolant-isolating conduits 60A-60C each having a channel for gaseous or liquid coolant passage therethrough are held in place between the turns 17 of the windings on each core leg.

Each U-shaped thermally conductive conduit has a first leg 62, a second leg 64 and a connecting portion 66 connecting the first leg 62 to the second leg 64. As noted previously, the conduit preferably, but not necessarily, is constructed of any non-magnetic metallic tubing such as copper tubing. As seen in FIG. 9, each conduit leg is held in place between the turns 17A which are wrapped about the core leg and the turns 17B which are wrapped outside each conduit leg 62 and 64 and over turns 17A. Each first conduit leg 62 is thus located between the turns 17A and 17B facing the first side 18A-18C of a transformer leg 13A-13C and each second conduit leg 44 is located between the turns 17A-17B of the windings facing the second side 20A-20C of the transformer leg 13A-13C, respectively. This positioning between the turns of the windings allows the conduit legs to be in excellent heat transfer contact with a great number of turns of the winding and thus provide efficient cooling of the windings.

If desired, the tubing comprising the first conduit leg 62 and the second conduit leg 64 may instead be bent in a zig zag or Z-shaped pattern. This patterning allows the turns of the windings to come in contact with more surface area of the conduit legs. The patterning thus provides more cooling ability than straight conduit legs.

The connecting portion 66 of the conduit, as seen in FIG. 8, crosses over the core to connect the first conduit leg 62 to the second conduit leg 64 to allow coolant to pass from the first conduit leg 62 to the second conduit leg 64.

The conduits 60A-60C may each be connected to a coolant reservoir or may be serially connected by connective tubing 69 to allow coolant to pass from one to another in any manner desired. In FIG. 9, for example, the second leg of conduit 60A is connected to the second leg of conduit 60B and the first leg of conduit 60B is connected to the first leg of conduit 60C thereby allowing coolant to pass from the conduits 60A to 60B to 60C. Since the coolant is enclosed within the conduits and isolated from contact with the windings most any liquid or gaseous coolant can be employed.

While one or more embodiments of the invention have been herein illustrated and described in detail, it will be understood that modifications and variations thereof may be effected without departing from the spirit of the invention and the scope of the appended claims.

What is claimed is:

1. A cooling apparatus in a transformer having a core with a plurality of legs, each said leg having first and second opposed sides wherein a set of windings is disposed about each leg, each set of windings include a number of turns, comprising:

a plurality of first and second heat exchangers, each said heat exchanger comprising a U-shaped coolant-isolating conduit having a channel therethrough for the passage of coolant, first and second legs and an interior U-shaped edge and a closed-U-shaped thermally conductive plate having first and second opposed sides and a U-shaped side edge said side edge in heat transfer contact with said interior edge of said conduit, wherein each said first heat exchanger is disposed between and in thermal contact with said turns of said set of windings facing said corresponding first side of said corresponding leg and wherein each said second heat exchanger is disposed between and in heat transfer contact with said turns of said set of windings facing said corresponding second side of said corresponding leg.

2. The cooling apparatus of claim 1, wherein said first side of said thermally conductive plate is convex and said second side of said thermally conductive plate in concave.

3. The cooling apparatus of claim 2, wherein said thermally conductive plate is composed of a non-magnetic metal.

4. The cooling apparatus of claim 2, wherein said non-magnetic metal is selected from the group consisting of copper, aluminum, titanium, stainless steel and alloys thereof.

5. The cooling apparatus of claim 1, wherein said U-shaped coolant-isolating conduit is fabricated of a non-magnetic metal.

6. The cooling apparatus of claim 5, wherein said U-shaped coolant-isolating conduit is fabricated of copper.

7. The cooling apparatus of claim 2, wherein said thermally conductive plate is bonded by a thermally conductive bonding agent to said conduit.

8. The cooling apparatus of claim 7, wherein said U-shaped side edge of said plate is concave and said conduit is copper tubing.

* * * * *